United States Patent [19]

Hay

[11] 4,136,464

[45] Jan. 30, 1979

[54] BOOT DRYING APPARATUS

[76] Inventor: Alexander Hay, 56 Maywood Park, Scarborough, Canada, M1K 2G8

[21] Appl. No.: 841,309

[22] Filed: Oct. 12, 1977

[51] Int. Cl.[2] ..... F26B 25/00

[52] U.S. Cl. ..... 34/104; 239/274

[58] Field of Search ..... 34/103, 104, 239, 202, 34/236, 80; 36/2.6; 239/274, 289, 551; 222/485, 486; 251/339; 137/625.33

[56] References Cited

U.S. PATENT DOCUMENTS

| | | | |
|---|---|---|---|
| 1,470,712 | 10/1923 | Demmler | 34/104 |
| 2,613,480 | 10/1952 | Mongan, Jr. | 34/104 |
| 3,513,564 | 5/1970 | Gramprie | 34/104 |
| 3,793,744 | 2/1974 | Saita | 34/104 |

FOREIGN PATENT DOCUMENTS

| | | | |
|---|---|---|---|
| 2050780 | 4/1971 | France | 34/104 |

*Primary Examiner*—Kenneth W. Sprague
*Assistant Examiner*—James C. Yeung
*Attorney, Agent, or Firm*—Robert D. Farkas

[57] ABSTRACT

A boot drying apparatus utilizes a hollow plenum chamber having a lowermost open mouth portion for resting upon a hot air discharge grill disposed in the surface of a floor of a room. The chamber supports a number of upright extending tubes, each having a snout-like portion pointed in one direction. Each of the tubes has a plurality of openings disposed along the length thereof as well as an additional opening being located at the end of the snout. A rod is carried by such that the rod is slidably affixed to the tube having the uppermost end thereof extending outwardly from the tube and having the lowermost end thereof formed into a lowermost leg of an L-shaped portion of the rod to which a plate is affixed. The plate is slidably located adjacent an opening in the plenum chamber as are a plurality of curved plates located and affixed to the rod adjacent the vertical leg portion thereof within the length of the tube. The plurality of openings of the tube are selectively covered by the plates affixed to the rod dependent upon the vertical position of the rod. A spring urges the uppermost end of the rod in an upward position such that the plates within the tube cover the opening of the tube and cover the opening inside the plenum chamber. Boots are placed selectively covering each of the tubes such that the sole of the boot is displaced in an uppermost position. The weight of the boot causes the rod to be depressed downwardly thereby uncovering the openings in the tube releasing hot air from them so as to dry out the boot. The additional opening constantly discharges warm air into the toe portion of the boot or shoe. When a shoe is placed upon a tube, the opening in the plenum chamber is similarly opened so as to cause additional warm air to enter the room facilitating drying out and carrying out the moisture laden air derived from the drying of the boot. Legs are provided in the form of sheets affixed to the exterior surface of the plenum chamber so as to provide additional vertical stability to the assembly when resting on the floor of the room.

8 Claims, 7 Drawing Figures

FIG. 1
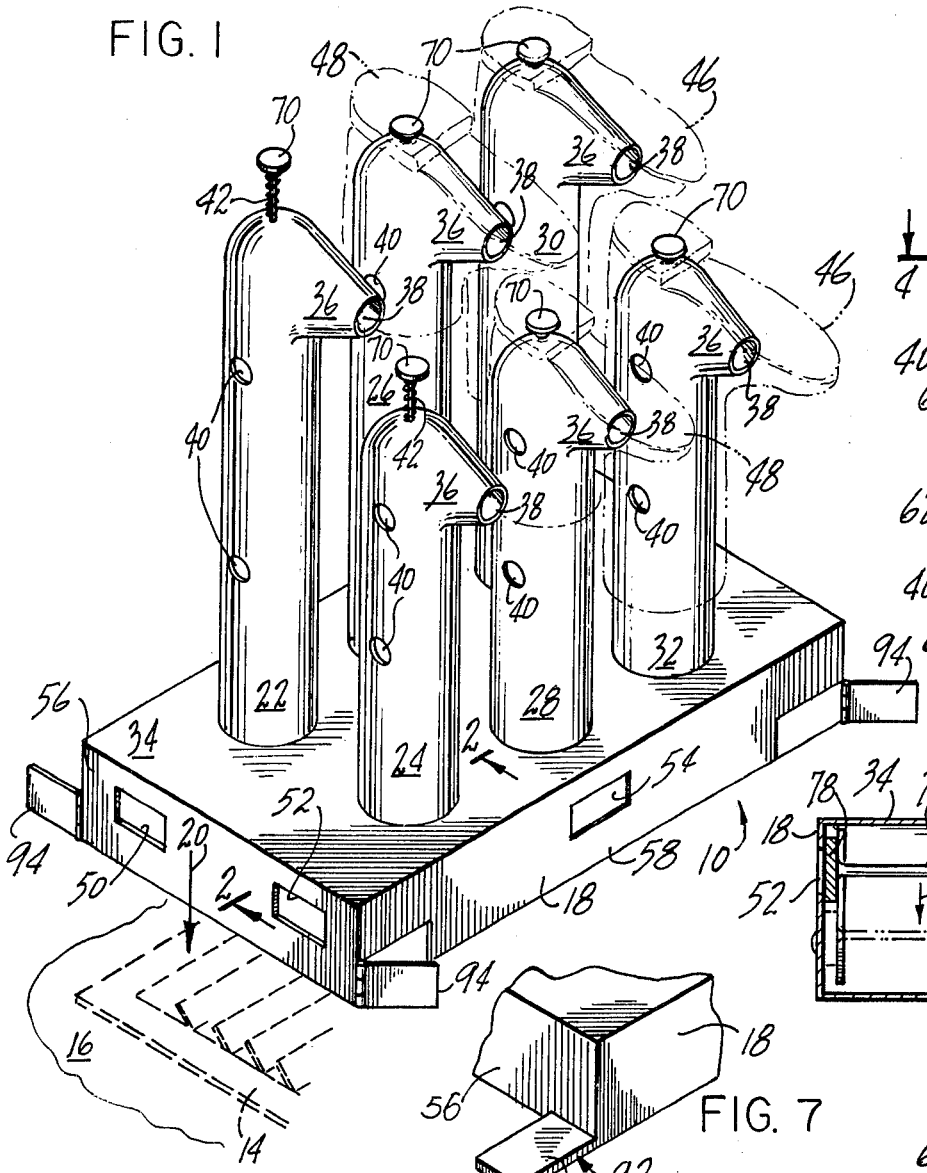
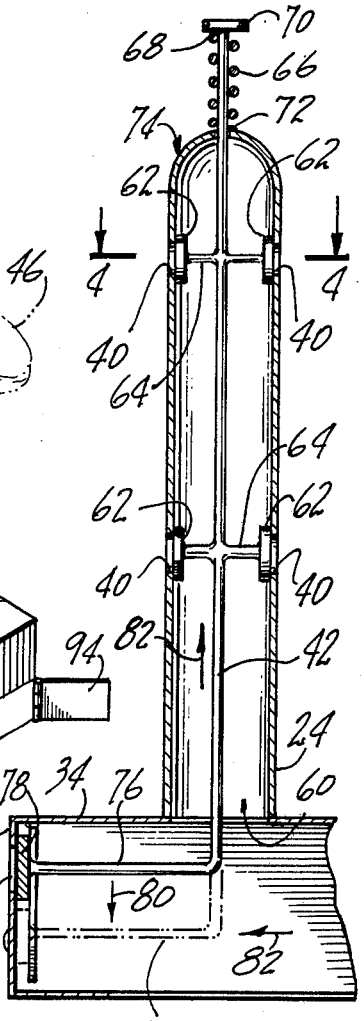
FIG. 2
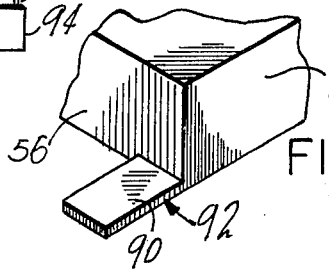
FIG. 7
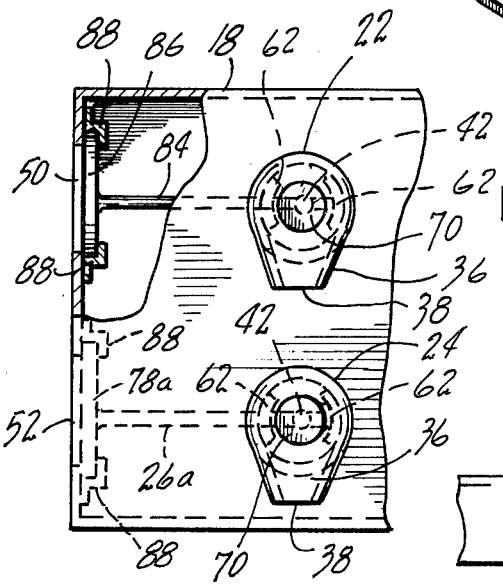
FIG. 3
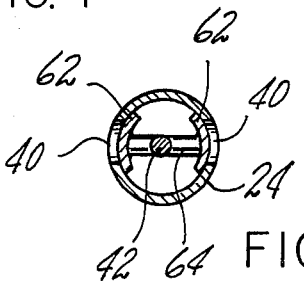
FIG. 4
FIG. 5
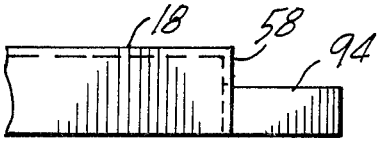
FIG. 6
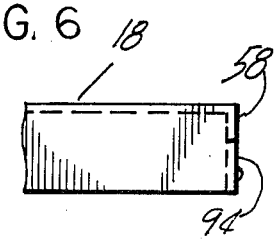

BOOT DRYING APPARATUS

BACKGROUND OF THE INVENTION

1. The Field of the Invention

This invention relates to boot dryers and more particularly to that class being used in combination with the conventional floor register which provides a source of heat for boots placed thereupon.

2. Description of the Prior Art

The prior art abounds with boot dryers of various constructions. Typical of such devices are the teachings of U.S. Pat. No. 3,154,392 issued on Oct. 27, 1964 to E. J. Littman and U.S. Pat. No. 3,513,564 issued on Mar. 21, 1968 to R. D. Grampie and U.S. Pat. No. 3,645,009 issued on Feb. 29, 1972 to C. E. Ketchum. Each of the aforementioned disclosures suffer from the common deficiency of requiring an internal heating element or a specially constructed external heating device which must be physically attached to the apparatuses thereof.

SUMMARY OF THE INVENTION

A primary object of the present invention is to provide a boot dryer that may be used in combination with a conventional floor register.

Another object of the present invention is to provide a lightweight portable and economically constructed boot dryer that may be used anywhere that a floor register is located, or to conveniently store boots thereupon when not being utilized as a boot dryer.

Still another object of the present invention is to provide a boot dryer which provides warm air extending outwardly from the plenum chamber thereof so as to warm the room in which the invention is located.

A further object of the present invention is to provide a plurality of drying tubes which may simultaneously dry out an equal number of boots.

A still further object of the present invention is to provide localized air passing in selected locations in the interior of the boot during the drying operation.

Heretofore, boot dryers utilized cold air or warm air generated by specifically devised heating apparatuses affixed thereto. Such devices required electrical connections which consumed power and tended to overheat the room in which the dryer was located, without efficiently and uniformly drying the interior of the boot. The present invention overcomes these disadvantages and utilizes a source of hot air, commonly available, as a discharge product of a floor register. Additionally, the present invention selectively provides high levels of heated air pressure to those tubes serving to support a boot to be dried only when the boot is placed over the tube. Thus heated air is discharged outwardly from any tube carrying a boot and only discharging air in small quantities from those tubes that are not carrying boots. Additionally, the plenum chamber of the present invention discharges air into the room in the vicinity of a boot to be dried, only when a boot is placed upon an associated tube.

These objects as well as other objects of the present invention will become more readily apparent after reading the following description of the accompanying drawings.

BRIEF DESCRIPTION OF THE DRAWINGS

FIG. 1 is a perspective view of the present invention.

FIG. 2 is a side-elevation cross-sectional view taken along lines 2—2, viewed in the direction of arrows 2—2, as shown in FIG. 1.

FIG. 3 is a partial expanded plan view of the apparatus shown in FIG. 1.

FIG. 4 is a cross-sectional plan view taken along lines 4—4, viewed in the direction of arrows 4—4 of the apparatus depicted in FIG. 2.

FIG. 5 is a side-elevational view of the apparatus shown in FIG. 1.

FIG. 6 is a side-elevational view of a portion of the apparatus shown in FIG. 1.

FIG. 7 is a partial perspective view of an alternate embodiment to the appratus illustrated in FIG. 1.

DESCRIPTION OF THE PREFERRED EMBODIMENT

The structure and method of fabrication of the present invention is applicable to a rectangular shaped plenum chamber having an open mouth portion located on the lowermost lateral surface of the chamber. A plate is hingably secured to each of the corners of the chamber so as to provide additional lateral support for the chamber when resting on a supporting surface such as the floor of a room. An alternate version of the hinge plate support mechanism is a plate fixedly secured to each of the corners of the chamber such that a lateral surface of the plate resides parallel to the plane defining the open mouth portion of the chamber. The uppermost lateral surface of the plenum chamber carries a plurality of upwardly extending tubes, preferably six in number. Such tubes, may be arranged so as to have unequal heights. Thus, three of the tubes may be of equal height but having a greater height than the remaining three tubes. Each of the tubes is provided with a snout-like projection, such that each projection is pointed in the same direction. A plurality of openings is located in the surface of each of the tubes as well as an additional opening located at the tip of the snout. The additional opening is always open. Each tube has an associated opening located in the wall of the plenum chamber and adjacent to the location of the tube. A hole is located in the uppermost surface of the plenum chamber such that the hole communicates with the interior of an adjacent tube. A rod extends vertically through each tube and upwardly outwardly from the uppermost end thereof. The rod is fitted with a circular button-like plate attached to the uppermost end of the rod. A helical spring is disposed wrapped about the exposed portion of the rod such that one end of the spring engages the button-like plate and the lowermost end of the spring engages the exterior surface of the uppermost end of the tube. The rod carries a number of curved plates affixed extending radially outwardly from the rod and located adjacent the plurality of openings in the tube. The lowermost end of the rod is affixed to a leg portion of the rod extending at right angles to the remaining portion of the L shape rod. A flat plate is affixed to the lowermost end of the rod and is located so as to have a lateral surface thereof disposed adjacent to the associated opening in the wall of the plenum chamber. Upon applying a downward force to the button-like plate at the uppermost end of the rod, each of the curved plates and the flat plate are moved downwardly so as to cause the plurality of openings in the tube, to which the rod is associated, and the associated opening in the wall of the plenum chamber, to open. Thus, warm air is permitted to extend outwardly from the associated opening and the plurality of openings in a tube whose rod is forced downwardly into a lowermost position. Of course, the additional opening is always free to discharge warm air emanating outwardly from the register communicating with the open mouth portion of the plenum chamber. When the uppermost end of the rod is released, the spring causes the rod to move upwardly so as to have the plurality of openings in the tube and the associated opening in the wall of the chamber to be closed. Boots are installed selectively on any of the tubes having the sole portion thereof extending in an uppermost position. On so doing, the weight of the boot causes the rod to be forced downwardly causing warm air to emerge outwardly from the plurality of openings in the tube and allowing warm air to enter the confines of the boat causing it to be dried out. Simultaneously, warm air emerges from the associated openings in the wall of the plenum chamber so that additional warm air enters the room to carry away the moisture-laden air created by the boot whilst drying. At all times, warm air is permitted to emerge from the additional opening in the snout of the tube. The additional plate, either fixedly secured or hingably secured to the exterior surface of the wall of the plenum chamber provide additional lateral support to the chamber and the plurality of tubes when boots are placed upon the tubes. The snout portions of the tubes are pointed towards the interior toe regions of the boot causing warm air to be directed towards the toe portion of the boot thereby enhancing the drying capabilities of the apparatus. When not in use, the plurality of openings in the tubes and the associated openings in the walls of the plenum chamber are permitted to be closed so as to allow a small quantity of warm air to enter the room emerging outwardly from the additional openings in the snout of the tube. When only a pair of boots are dried, only those plurality of openings of the tubes upon which boots are placed, and the associated openings in the walls of the plenum chamber are opened thereby permitting a flow of high pressure heated air to enter that pair of boots to be dried.

Now referring to the Figures and more particularly to FIG. 1 showing the present invention 10 residing above a warm air register 14 disposed in the surface of floor 16. Plenum chamber 18 is adapted to be lowered in the direction of arrow 20 such that chamber 18 substantially covers all of the open regions of register 14. A plurality of tubes 22, 24, 26, 28, 30 and 32 are shown residing on an uppermost surface 34 of chamber 18. Tubes 22, 26 and 30 are shown having a greater height than tubes 24, 28 and 32. Each of the tubes are provided with a snout-like portion 36. Openings 38 are located at the outermost end of snout-like portion 36 and are directed radially outwardly from the longitudinal axes of tubes 22, 24, 26, 28, 30 and 32. Each of the tubes are provided with a plurality of openings 40 which are located along the length of the tubes. Rods 42 are shown extending upwardly from the outermost uppermost surface of the tubes and have button-like plates 70 affixed to the uppermost end of the rod. Dotted Lines 46 simulate boots having a long shank portion. Dotted lines 48 simulate "low" boots. It should be noted that rod 42 of tubes 26, 28, 30 and 32 are shown in a depressed position, whilst rods 42 of tubes 22 and 24 are shown in an upper position relative thereto. Openings 50, 52 and 54 are provided in walls 56 and 58 of plenum chamber 18. Opening 50 is associated with tube 22. Opening 52 is associated with tube 24. Opening 54 is associated with tube 28. Additional openings not shown, are associated with tubes 26, 30 and 32 by being located adjacent to the tubes closest to them, as are openings 50, 52 and 54. Plates 94 are hingably secured to the corners of walls 56 and 58 so as to provide increased lateral support to plenum chamber 18 required when boots are placed upon the tubes.

FIG. 2 illustrates plenum chamber 18 having hole 60 located in uppermost lateral surface 34 of the chamber. Hole 60 is located and surrounded by the walls of tube 24. Rod 42 is shown passing through the center of tube 24. Tube 24 carries openings 40 therein which are shown in a closed condition due to the location of plates 62 being disposed covering openings 40. Plates 62 are secured to rod 42 and extend radially outwardly therefrom by utilizing rods 64. Helical spring 66 is shown wrapped about an exposed portion of rod 42, having end 68 of spring 66 shown in touching engagement with button-like plate 70 affixed to the uppermost end of rod 42 and having end 72 of spring 66 shown in touching engagement with the exterior surface 74, of tube 24. Rod 42 is shown having an L-shaped cross-section with leg 76 shown disposed in a substantially horizontal position. Opening 52 located in wall 94 of plenum chamber 18 is shown covered by flat plate 78 affixed to the end of leg 76. When rod 42 is moved downwardly in the direction of arrow 80 by applying a downward force on the direction of button-like plate 70, leg 76 resides in the position shown by dotted lines 76*a* such that flat plate 78 is disposed uncovering opening 52 and plates 62 are moved downwardly so as to uncover and cause openings 40 to become open. Warm air, traveling in the direction of arrow 82 is then permitted to emerge outwardly from opening 40 as well as opening 52.

FIG. 3 illustrates plenum chamber 18 having openings 50 and 52 in wall 94. Leg 76, as shown in FIG. 2 is illustrated by dotted lines 76*a* carrying plate 78*a* residing parallel to opening 52. Leg 84 is shown carrying plate 86 which is disposed adjacent opening 50. Tracks 88 provide vertical support for the sliding engagement of plates 86 and 78*a*. Curved plates 62 are illustrated within tubes 22 and 24. Additional openings 38 are shown at the ends of snout-like portions 36 of tubes 22 and 24.

FIG. 4 illustrates tube 24 having openings 40 to which curved plates 62 are disposed in juxtaposed position. Rods 64 carry curved plates 62 and are secured to rod 42 disposed in the center of tube 24.

FIG. 5 illustrates plenum chamber 18 having plate 56 extending outwardly from surface 58 thereof so as to act like an outwardly extending foot.

FIG. 6 illustrates plate 56 shown in a stored position by residing parallel to wall 58. Thus plate 56 need not project outwardly when not utilized as a foot providing support to plenum chamber 18.

FIG. 7 illustrates plate 90 extending outwardly from wall 56 so as to form a foot-like surface 92 utilized to enhance lateral support to plenum chamber 18, as an alternate embodiment of plate 56 shown in FIGS. 1, 5 and 6.

One of the advantages of the present invention is a boot dryer that may be used in combination with a conventional floor register.

Another advantage of the present invention is a lightweight portable and economically constructed boot dryer that may be used anywhere that a floor register is located, or to conveniently store boots thereupon when not being utilized as a boot dryer.

Still another advantage of the present invention is a boot dryer which provides warm air extending outwardly from the plenum chamber thereof so as to warm the room in which the invention is located.

A further advantage of the present invention is a plurality of drying tubes which may be simultaneously drying out an equal number of boots.

A still further advantage of the present invention is to provide localized air passing through selected locations in the interior of the boot during the drying operation.

Thus there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

I claim:

1. A boot drying apparatus comprising a plenum chamber, said plenum chamber having an open mouth portion, said plenum chamber having walls adjacent said open mouth portion thereof, said walls having a plurality of openings therein communicating to the interior of said plenum chamber, said open mouth portion of said plenum chamber located at a lower surface thereof, said plenum chamber having an upper surface, said walls being located intermediate said open mouth portion and said upper surface, said upper surface having a plurality of holes therein, a plurality of tubes, said plurality of tubes and said plurality of holes and said plurality of openings being equal in number, said plurality of tubes fixedly secured to said uppermost surface, each of said tubes having an opening at one end, said opening at said one end interlocated surrounding said holes in said upper surface, each of said tubes extending upwardly from said surface and having the longitudinal axes thereof being disposed substantially parallel to one another, each of said tubes having a plurality of openings in the walls thereof, said each of said tubes having a rod extending along the length of said tubes, means to bias the uppermost end of said rod upwardly away from said plenum chamber in an uppermost position, said plurality of openings in said each of said tubes being disposed in a closed position and said plurality of openings in said plenum chamber being disposed in a closed position when said rod is disposed in said uppermost position, said plurality of said openings in said each of said tubes being disposed in an open position when said plurality of said openings in said plenum chamber being disposed in an open position when said rod is disposed in a downward position, an additional opening in the surface of said tubes located in the uppermost region of said tubes, said additional opening being disposed open independent of the location of said rod.

2. The apparatus as claimed in claim 1 further comprising a plurality of sheets, said sheets being disposed extending outwardly from the surface of said plenum chamber, said plurality of said sheets being located adjacent said open mouth portion of said plenum chamber.

3. The apparatus as claimed in claim 2 wherein said plurality of said sheets are hingably secured to said exterior surface of said plenum chamber.

4. The apparatus as claimed in claim 1 wherein each of said additional openings are directed having their open mouth portion pointed in one direction.

5. The apparatus as claimed in claim 1 further comprising a plurality of plates, said plurality of plates fixedly secured to said rod, the lateral surface of said plurality of plates being disposed covering said plurality of openings in said tube when said rod is located in said uppermost position and one of said plurality of plates being disposed uncovering said plurality of openings when said rod is disposed in said uppermost position.

6. The apparatus as claimed in claim 1 further comprising a helical spring, said rod having a plate affixed to the uppermost end thereof, said helical spring being disposed wrapped around said rod, one end of said spring in touching engagement with said one end of said rod, the other end of said spring being disposed in touching engagement with the uppermost surface of said tube.

7. The apparatus as claimed in claim 1 further comprising the said uppermost end of said tubes having a portion thereof extending radially outwardly from the remaining cylindrical portions of said plurality of tubes, said additional opening being located in said portion of said plurality of tubes.

8. The apparatus as claimed in claim 1 wherein said plenum chamber comprises a rectangular shape.

* * * * *